US012714946B1

(12) United States Patent
Zhang

(10) Patent No.: US 12,714,946 B1
(45) Date of Patent: Aug. 25, 2026

(54) FLEXIBLE TOY VEHICLE TRACK

(71) Applicant: Xiaoting Zhang, Shenzhen (CN)

(72) Inventor: Xiaoting Zhang, Shenzhen (CN)

( * ) Notice: Subject to any disclaimer, the term of this patent is extended or adjusted under 35 U.S.C. 154(b) by 0 days.

(21) Appl. No.: 19/325,872

(22) Filed: Sep. 11, 2025

(30) Foreign Application Priority Data

Jul. 22, 2025 (CN) ..... 202521540670.2

(51) Int. Cl.
*A63H 18/02* (2006.01)

(52) U.S. Cl.
CPC ..... *A63H 18/021* (2013.01)

(58) Field of Classification Search
CPC ..... A63H 18/02; A63H 18/021; A63H 33/10; A63H 33/105
USPC ..... 446/111, 122
See application file for complete search history.

(56) References Cited

U.S. PATENT DOCUMENTS 2,862,333 A * 12/1958 Gardiol ..... A63H 18/02 105/69
3,480,210 A * 11/1969 Perrinjaquet ..... A63F 9/14 238/10 R
3,487,999 A * 1/1970 Branche ..... A63H 18/02 238/10 R
3,587,190 A * 6/1971 Ashton ..... A63F 7/3622 446/168
3,712,539 A * 1/1973 Staats ..... A63H 18/02 238/10 E
3,712,540 A * 1/1973 Yamasaki ..... A63H 18/02 238/10 E
3,734,404 A * 5/1973 Baynes ..... A63H 18/02 238/10 E
3,735,923 A * 5/1973 Brigham ..... A63H 18/028 463/58
4,140,276 A * 2/1979 Halford ..... A63H 18/02 238/10 F
4,397,419 A * 8/1983 Fischer ..... A63H 18/021 238/10 F
6,093,079 A * 7/2000 House ..... A63H 18/02 238/10 F
6,601,774 B1 * 8/2003 Kasimoff ..... A63H 18/02 238/10 R
6,951,497 B1 * 10/2005 Ngan ..... A63H 18/028 446/444
8,382,553 B2 * 2/2013 O'Connor ..... A63H 18/02 446/444
8,758,078 B2 * 6/2014 Damarin ..... A63H 18/021 446/444
9,345,980 B2 * 5/2016 Lee ..... A63H 18/02
10,512,852 B2 * 12/2019 Fung ..... A63H 18/04
10,537,817 B2 * 1/2020 Musliner ..... A63H 17/36
11,504,639 B2 * 11/2022 Cao ..... A63H 18/021
2006/0196961 A1 * 9/2006 Belding ..... A63H 18/02 238/10 R (Continued)

*Primary Examiner* — Kurt Fernstrom
(74) *Attorney, Agent, or Firm* — Law Offices of Sandy Lipkin; Sandy Lipkin

(57) ABSTRACT

A flexible toy vehicle track with an unlimited length includes a track main body and at least one connecting portion. The track main body is connected to the connecting portion. The track main body includes at least one track. The track is configured for the toy vehicle to run on. The connecting portion is provided at a side away from the track. The connecting portion is configured for detachably connecting the flexible toy vehicle track to another flexible toy vehicle track to use.

17 Claims, 8 Drawing Sheets

(56) References Cited

U.S. PATENT DOCUMENTS

2007/0037479 A1* 2/2007 Margay ..... A63H 18/02
238/10 F

* cited by examiner

FLEXIBLE TOY VEHICLE TRACK

CROSS-REFERENCE TO RELATED APPLICATIONS

The application claims priority of Chinese patent application CN2025215406702, filed on Jul. 22, 2025, which is incorporated herein by reference in its entirety.

TECHNICAL FIELD

The present invention relates to the field of toy track, and in particular to a flexible toy vehicle track.

BACKGROUND ART

Most of the flexible toy vehicle tracks sold on the market are made of hard materials, and when used and stored, separate splicing and disassembly are required, inconvenient for the user to use and store. Moreover, most flexible toy vehicle tracks on the market is fixed in length and shape and cannot be cut according to the required size, placing certain requirements on the environment and space for use. And usually a long track needs to be spliced by a plurality of short rails, through which splicing and disassembling is troublesome. To this end, the present invention provides a flexible toy vehicle track, which can effectively solve the above problems.

SUMMARY

In order to overcome the shortcomings of the prior art, the present invention provides a flexible toy vehicle track. The flexible toy vehicle track includes a track main body and at least one connecting portion. The track main body is connected to the connecting portion. The track main body includes at least one track, and the track is configured for the toy vehicle to run on. The connecting portion is arranged on a side away from the track. The connecting portion is configured for detachably connecting the flexible toy vehicle track to another flexible toy vehicle track.

Further, the connecting portion extends from a first end of the track main body to a second end of the track main body.

Further, the connecting portion is configured for detachably connecting to the other flexible toy vehicle tracks via an external connector.

Further, the connecting portion includes an enclosure wall, two ends of the enclosure wall are connected to the track main body. The enclosure wall and the track main body surround to form a connecting channel, and the connecting channel is configured for coupling with the external connector.

Further, the surrounding wall extends from the first end of the track main body to the second end of the track main body, so that the connecting channel extends from the first end of the track main body to the second end of the track main body.

Further, the connecting portion further includes at least one side wall. The side wall is arranged in the connecting channel. The side wall is configured for dividing the connecting channel into a first connecting channel and a second connecting channel.

Further, a first side of the side wall is connected to the track main body, and a second side of the side wall is connected to the enclosure wall. The side wall is configured for supporting the track main body and the enclosure wall to prevent the track main body and the enclosure wall from a concave deformation or a convex deformation.

Further, the side wall extends from the first end of the track main body to the second end of the track main body, so that the first connecting channel and the second connecting channel extend from the first end of the track main body to the second end of the track main body.

Further, a size of the first connecting channel is identical to a size of the second connecting channel, so that when the plurality of flexible toy vehicle tracks are connected by the external connector, a force on the first connecting channel and the second connecting channel is balanced.

Further, the enclosure wall includes a first wall, a second wall, and a third wall. A first side of the first wall is connected to the track main body. A second side of the first wall is connected to a first side of the second wall. A second side of the second wall is connected to a first side of the third wall. A second side of the third wall is connected to the track main body.

Further, the first wall and the second wall are arranged at a right angle relative to each other.

Further, the third wall and the second wall are arranged at a right angle relative to each other.

Further, the track main body further includes a track panel and two baffles. The baffles are respectively connected to two sides of the track panel, and the two baffles are connected to the track panel to form the track.

Further, a width of the baffle plate gradually increasing from a top to a bottom is configured for forming an inclined guiding surface.

Further, the baffle extends from a first end of the track panel to a second end of the track panel. The baffle is configured for preventing the toy vehicle from sliding out of the track.

Further, a rounded corner is provided on a side of the baffle away from the track panel.

Further, a material for manufacturing the flexible toy vehicle track is PVC.

Further, the flexible toy vehicle track is integrally formed by extrusion.

Further, a reinforcing rib is provided on two sides of the track main body to enhance the strength of the track main body.

Further, a cross section of the connecting portion is a relatively flat shape, so that a thickness of the flexible toy vehicle track is reduced.

The beneficial effects of the present invention are: the present invention provides a flexible toy vehicle track made of a soft material and can be bent at will, so the user can roll up the flexible toy vehicle track to carry it, convenient for the user to store. Moreover, the user can change the flexible toy vehicle track to a variety of angles to add more fun to the user, and the user can cut the flexible toy vehicle track into a required length according to the user's own needs, thereby improving the user experience. The flexible toy vehicle track is provided with a connecting portion of a length identical to the flexible toy vehicle track, so that the two or more flexible toy vehicle tracks can be connected together for use by an external connector. And the user can cut off the flexible toy vehicle track at any position. The truncated flexible toy vehicle track is still with the connecting portion, and can be connected to other flexible toy vehicle tracks by the external connector, thereby greatly providing convenience to the user and improving the user experience.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
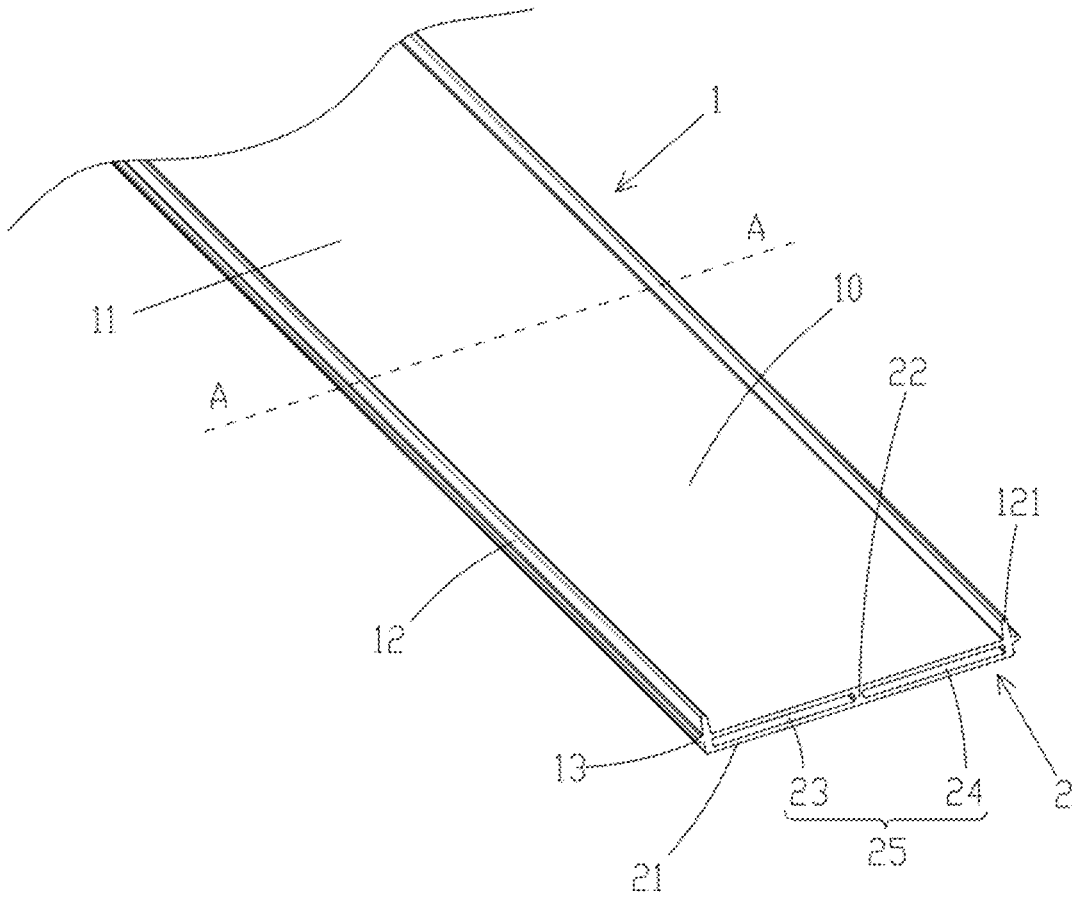
FIG. 1 is a perspective view of a flexible toy vehicle track according to Embodiment 1 of the present invention.
Figure 2:
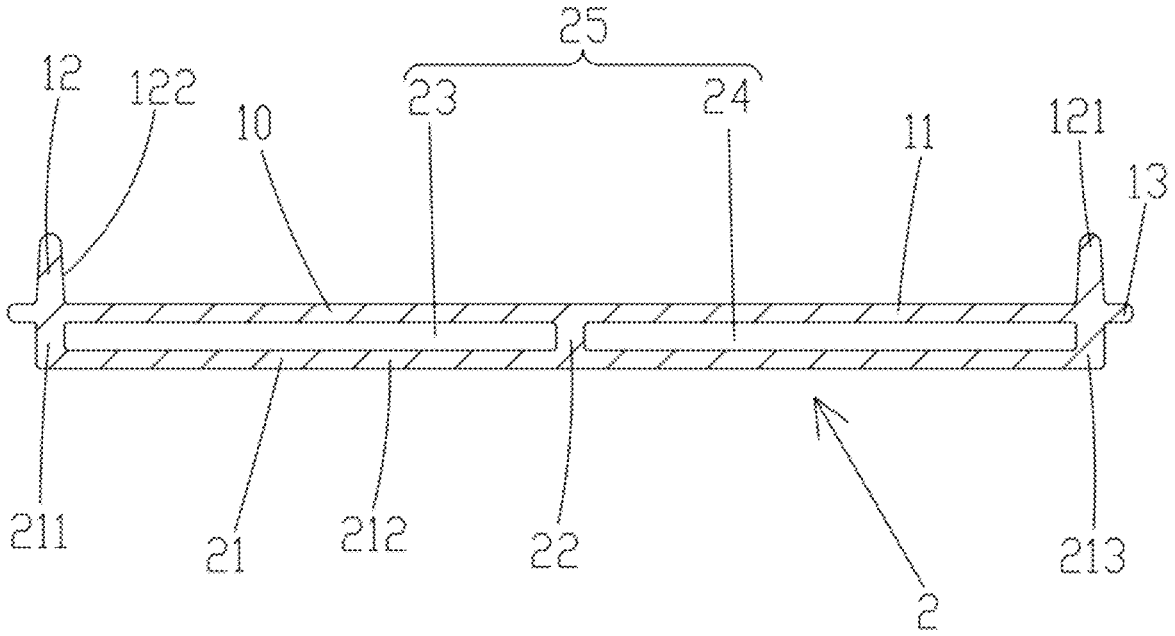
FIG. 2 is a cross-sectional view of a dashed line at a delay A in FIG. 1.
Figure 3:
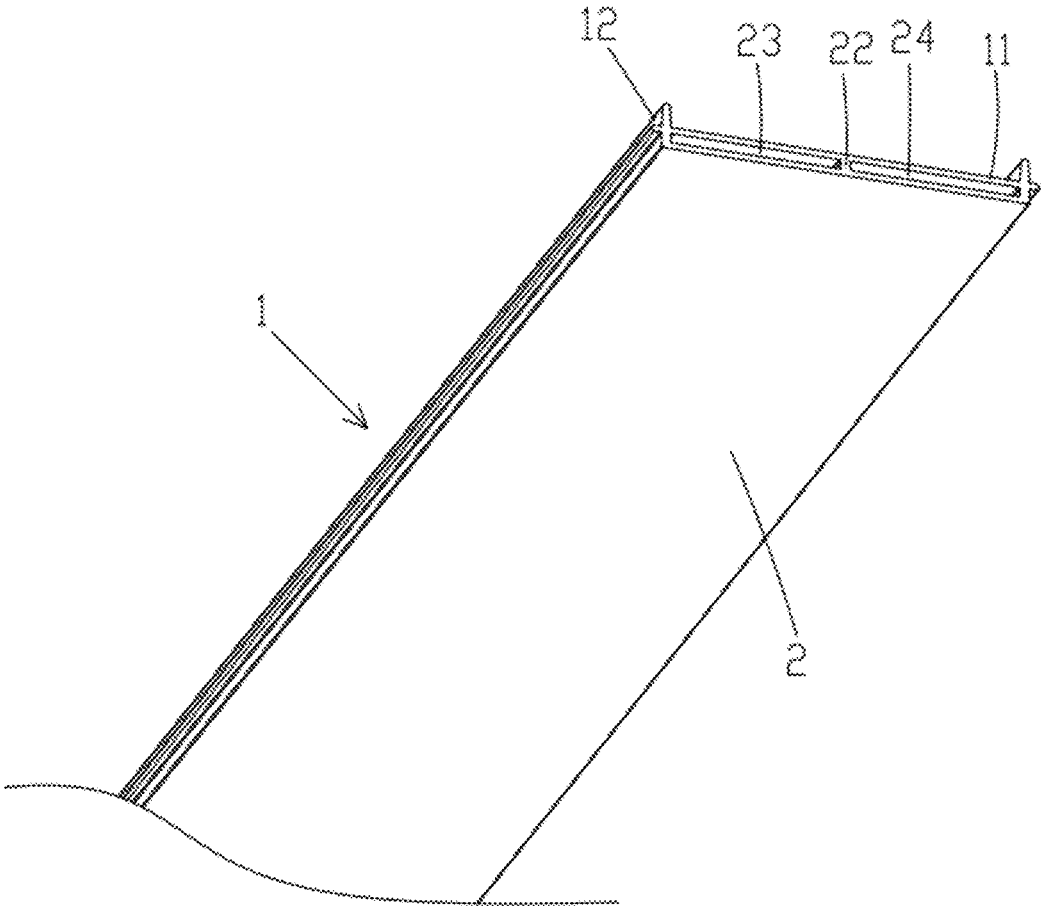
FIG. 3 is another perspective view of Embodiment 1 of the flexible toy vehicle track of the present invention.
Figure 4:
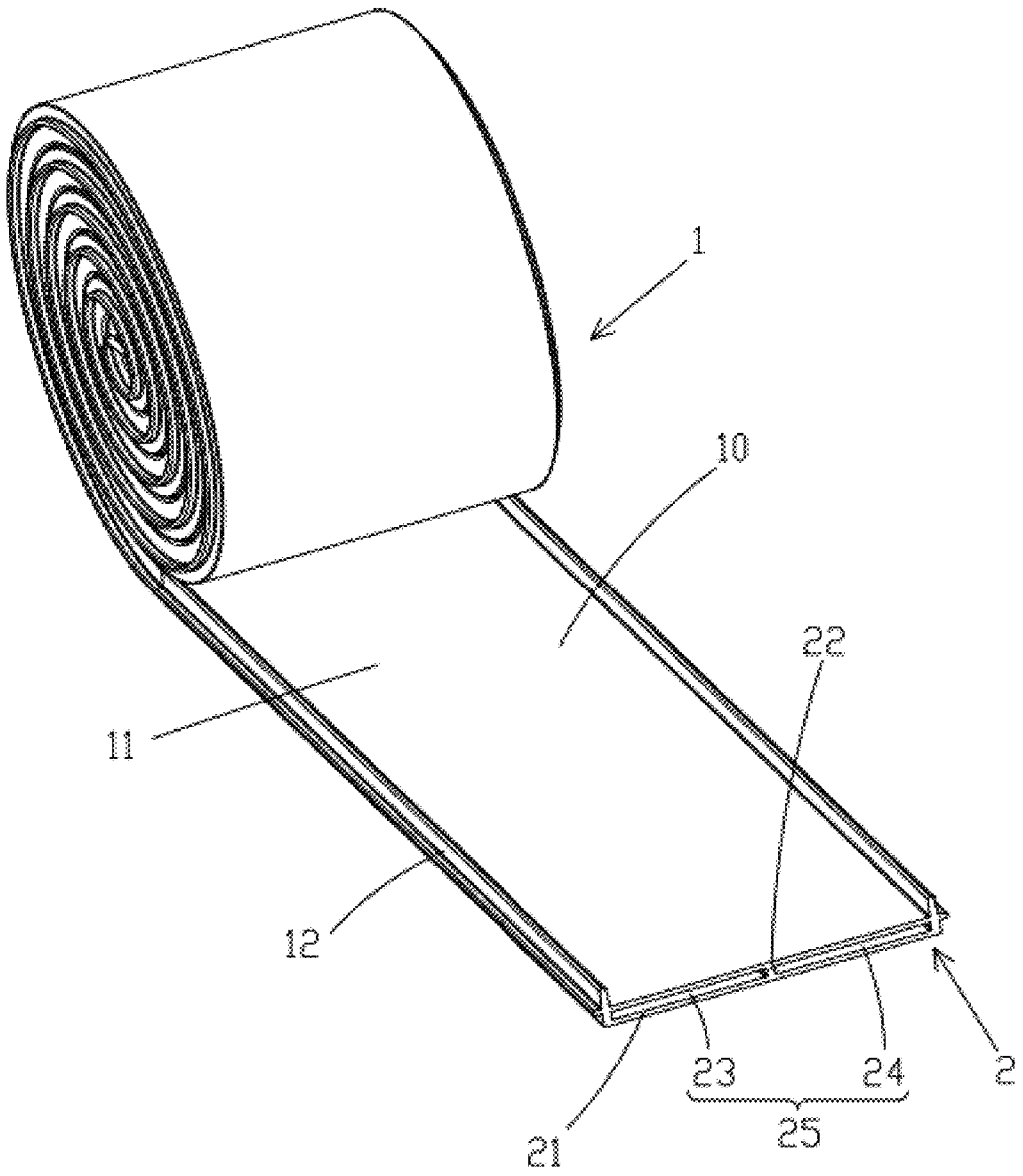
FIG. 4 is a use state diagram of the flexible toy vehicle track when the flexible toy vehicle track of the present invention is rolled up in Embodiment 1.
Figure 5:
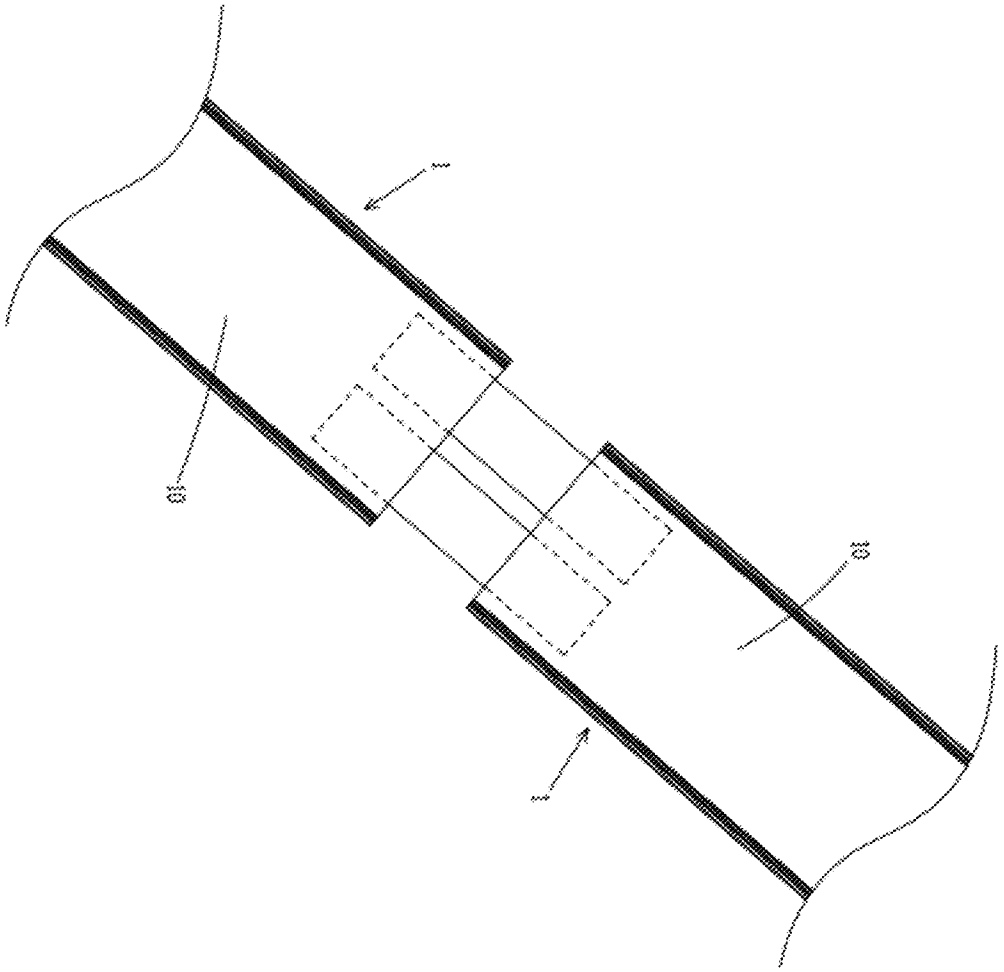
FIG. 5 is a combined use state diagram of Embodiment 1 of the flexible toy vehicle track of the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Referring to FIG. 1 to FIG. 6, the present invention provides a flexible toy vehicle track. The flexible toy vehicle track includes a track main body 1, and a connecting portion 2. The track main body 1 is connected to the connecting portion 2. The track main body 1 includes at least one track 10, and the track 10 is configured for the toy vehicle to run on. The connecting portion 2 is arranged on a side away from the track 10, and the connecting portion 2 is configured for detachably connecting a flexible toy vehicle track to another flexible toy vehicle track.

The flexible toy vehicle track is made of a soft material, and is not limited in length. Due to the soft material, the user can bend the flexible toy vehicle track to change a plurality of angles when in use, for example, flexible toy vehicle tracks can be made into sideways curves or undulating slopes that bend up and down, providing the user more gameplay and enjoyment. In addition, the user can roll up the flexible toy vehicle track at any time, convenient for the user to store and carry. At the same time, the soft material also facilitates the user to crop the flexible toy vehicle track according to a specific required length. The flexible toy vehicle track includes a track main body 1 and a connecting portion 2. The track main body 1 is connected to the connecting portion 2. The track main body 1 includes at least one track 10, and the track 10 is configured for the toy vehicle to run on. The plurality of flexible toy vehicle tracks may be detachably connected to each other by the connecting portion 2 to form a longer and diverse flexible toy vehicle track. The track 10 may be one or more, and may be produced according to different market requirements. The connecting portion 2 is arranged below the track 10. The user may detachably connect the plurality of flexible toy vehicle tracks to each other by the connecting portion 2, which is convenient for a user to use and improves the user experience.

In this embodiment, the connecting portion 2 is configured for detachably connecting to other flexible toy vehicle tracks through an external connector. Through the structural arrangement, the external connector can be inserted into the connecting portion 2 so that the plurality of flexible toy vehicle tracks can be detachably connected to each other by the connecting portion 2. The operation is simple and convenient for the user.

In the present embodiment, the connecting portion 2 extends from a first end of the track main body 1 to a second end of the track main body 1. Through the described structure, the user may transversely cut the flexible toy vehicle track at any length position. The cut flexible toy vehicle track still has the connecting portion 2. The user can still connect the severed flexible toy vehicle track to other flexible toy vehicle tracks by coupling the external connector with connection portion 2, thereby enhancing the user experience.

Figure 6:
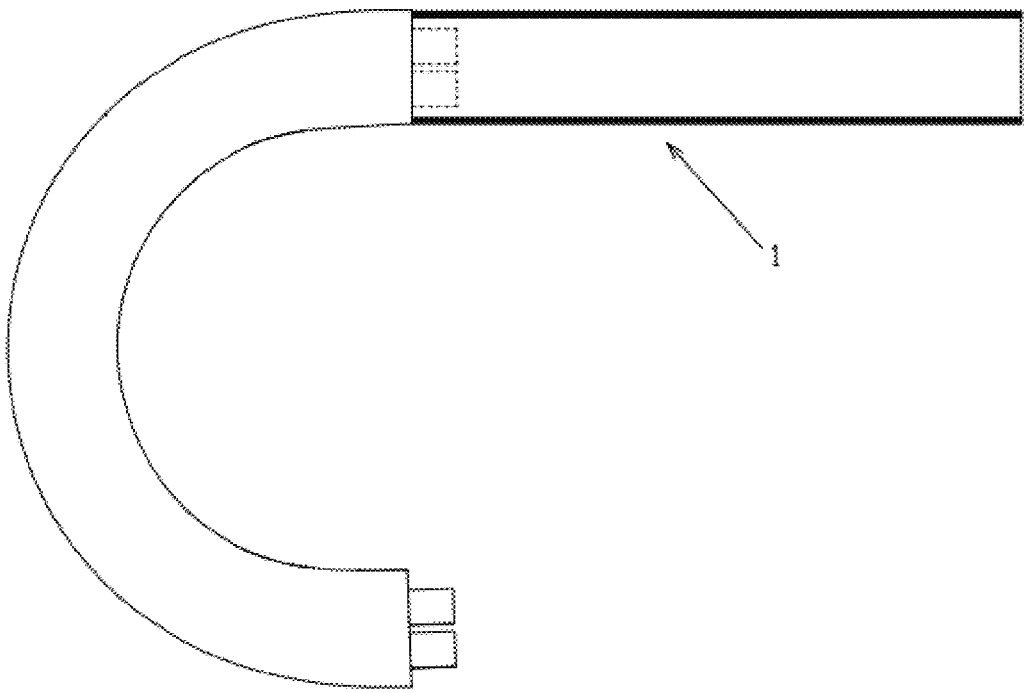
FIG. 6 is another combined use state diagram of the flexible toy vehicle track Embodiment 1 of the present invention.

As shown in FIG. 6, in this embodiment, the flexible toy vehicle track may also be connected to other toy vehicle track products with connectors through the connecting portion 2. Connectors of other toy vehicle track products are configured for coupling with the connecting portion 2 of the flexible toy vehicle track to form a new track structure with the flexible toy vehicle track, providing a new playing method for the user and greatly improving the inventive step of the user when using the flexible toy vehicle track.

In the present embodiment, the connecting portion 2 includes an enclosure wall 21. Two ends of the enclosure wall 21 are connected to the track main body 1. The enclosure wall 21 and the track main body 1 surround to form a connecting channel 25. The connecting channel 25 is configured for coupling with the external connector. The enclosure wall 21 is arranged on a back surface of the track main body 1. The enclosure wall 21 and the track main body 1 surround to form a connecting channel 25. The user can couple the external connector with the connecting channel 25, so that the plurality of flexible toy vehicle tracks are connected to each other. The structure is simple and reliable, and the user operation is facilitated. Quite usefully, the enclosure wall 21 extends from the first end of the track main body 1 to the second end of the track main body 1, so that the connecting channel 25 extends from the first end of the track main body 1 to the second end of the track main body 1. By the described structure, after the flexible toy vehicle track is cut at any position, the severed flexible toy vehicle track still has the enclosure wall and the connecting channel 25. The user can still connect the severed flexible toy vehicle track to each other with the external connector to use. The structural design is ingenious, and provides significant convenience for the user.

In the present embodiment, the connecting portion 2 further includes at least one side wall 22. The side wall 22 is arranged in the connecting channel 25. The side wall 22 is configured for dividing the connecting channel 25 into a first connecting channel 23 and a second connecting channel 24. Through the above-described structure, the side wall 22 divides the connecting channel 25 into a first connecting channel 23 and a second connecting channel 24, so that the user can couple the external connector with the first connecting channel 23 and the second connecting channel 24, increasing the stability of a connection between the plurality of flexible toy vehicle tracks. This provides a more secure connection compared to using a single connecting channel. Quite usefully, a size of the first connecting channel 23 is identical to a size of the second connecting channel 24. In the above-described structure, the size of the first connecting channel 23 is identical to the size of the second connecting channel 24. After the external connector is inserted into the first connecting channel 23 and the second connecting channel 24, a force on the first connecting channel 23 and the second connecting channel 24 can be more balanced, thereby further enhancing the stability of the connection between the plurality of flexible toy vehicle tracks.

In the present embodiment, the side wall 22 extends from the first end of the track main body 1 to the second end of the track main body 1. By the described structural arrangement, the first connecting channel 23 and the second connecting channel 24 can be identical to the track main body 1 in length. After the user truncates the flexible toy vehicle track at any position, the truncated flexible toy vehicle track still has a first connecting channel 23 and a second connecting channel 24. The user can still couple the external connector with the first connecting channel 23 and the second connecting channel 24, and connect cut sections of the flexible toy vehicle track for continued use.

In the present embodiment, a first side of the side wall 22 is connected to the track main body 1. A second side of the side wall 22 is connected to the enclosure wall 21. The side wall 22 is configured for supporting the track main body 1 and the enclosure wall 21, so as to prevent the track main body 1 and the enclosure wall 21 from a concave deformation or a convex deformation. By the described structure, the first side of the side wall 22 is connected to the track main body 1, and the second side of the side wall 22 is connected to the enclosure wall 21, so that the track main body 1 and the enclosure wall 21 do not generate the concave deformation or convex deformation, the track 10 is more flat, and a strength of the connecting portion 2 is also increased.

In the present embodiment, the enclosure wall 21 includes a first wall 211, a second wall 212, and a third wall 213. A first side of the first wall 211 is connected to the track main body 1. A second side of the first wall 211 is connected to a first side of the second wall 212. A second side of the second wall 212 is connected to a first side of the third wall 213. A second side of the third wall 213 is connected to the track main body 1. Through the described structure, the enclosure wall 21 includes the first wall 211, the second wall 212, and the third wall 213. The first side of the first wall 211 is connected to the track main body 1. The second side of the first wall 211 is connected to the first side of the second wall 212. The second side of the second wall 212 is connected to the first side of the third wall 213. The second side of the third wall 213 is connected to the track main body 1. The first wall 211, the second wall 212, the third wall 213 and the track main body 1 surround to form a connecting channel 25. Quite usefully, the first wall 211 and the second wall 212 are arranged at right angles relative to each other. The third wall 213 and the second wall 212 are arranged at right angles relative to each other. Through the described structure, the strength of the connecting portion 2 can be further increased.

In the present embodiment, the track main body 1 further includes a track panel 11 and two baffles 12. The baffles 12 are respectively connected to two sides of the track panel 11, the two baffles 12 and the track panel 11 are connected to form the track 10. Through the described structure, the track main body 1 includes a track panel 11 and two baffles 12, and a front surface of the track panel 11 is configured for the toy vehicle to run on. The two baffles 12 are relatively set on two relatively longer sides of the track panel 11 to form the track 10. The two baffles 12 are configured for preventing toy vehicles from sliding out of the track 10. Quite usefully, the baffle 12 extends from a first end of the track panel 11 to a second end of the track panel 11. After the flexible toy vehicle track is transversely truncated at any position, the flexible toy vehicle track still has the baffle 12 and the track panel 11, and the baffle 12 can prevent the toy vehicle from sliding out of the track 10.

In the present embodiment, a width of the baffle 12 gradually increases from top to bottom to form an inclined guiding surface 122. By the described structure, the width of the baffle 12 gradually increases from top to bottom to form an inclined guiding surface 122, and the guiding surface 122 can better enable the toy vehicle to run on the track 10.

In the present embodiment, a side of the baffle 12 away from the track panel 11 is provided with a rounded corner 121 with a radian. Through the described structure, a side of the baffle 12 away from the track panel 11 is provided with a rounded corner 121. When the user uses the flexible toy vehicle track, the rounded corner 121 can protect the user from being scratched by the baffle 12.

In this embodiment, a material for manufacturing the flexible toy vehicle track is Poly Vinyl Chloride (PVC). The PVC material can not only provide better flexibility, but also has good corrosion resistance and flame retardancy, thereby improving the usage safety of the flexible toy vehicle track.

In this embodiment, the flexible toy vehicle track is integrally formed by extrusion. By the above structural arrangement, the flexible toy vehicle track is integrally formed by extrusion, so as to produce tracks of unlimited length, and then obtain any desired length of flexible toy vehicle track by cutting, so that the production process is simple, and the production cost is effectively reduced.

In the present embodiment, reinforcing ribs 13 are provided on both sides of the track main body 1 to enhance the strength of the track main body 1. Through the described structure, by arranging the reinforcing ribs 13 on both sides of the track main body 1, the strength of the track main body 1 can be increased, so that the track main body 1 will not easily deform.

In this embodiment, a cross section of the connecting portion 2 is a flat shape to reduce a thickness of the flexible toy vehicle track. By the described structural arrangement, the cross section of the connecting portion 2 is a flat shape, so that the thickness of the connecting portion 2 is small, so that the overall thickness of the whole flexible toy vehicle track is small. When the user rolls up the flexible toy vehicle track, an overall volume is small, which is convenient for the user to store and carry.

Figure 7:
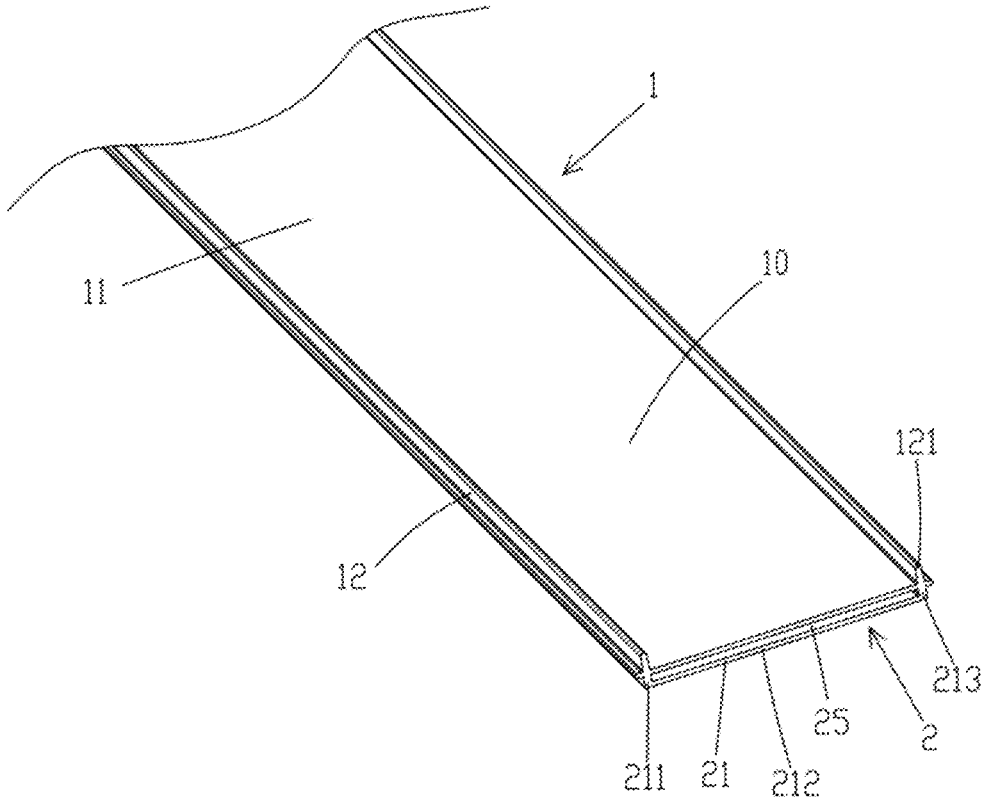
FIG. 7 is a perspective view of a flexible toy vehicle track of Embodiment 2 of the present invention.
Figure 8:
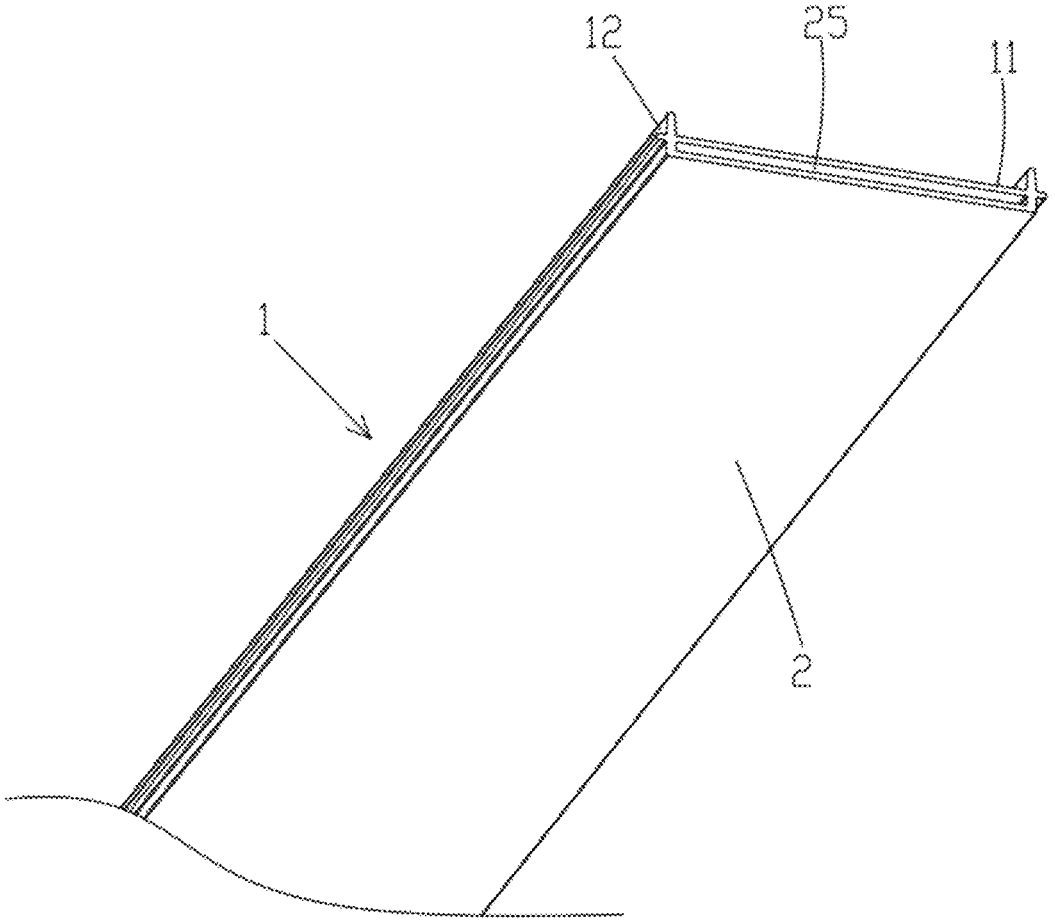
FIG. 8 is another perspective view of the flexible toy vehicle track of Embodiment 2 of the present invention.

Referring to FIG. 7 to FIG. 8, compared with Embodiment 1, embodiment 2 does not provide a side wall 22, a first connecting channel 23, and a second connecting channel 24, and other structural configurations are identical to Embodiment 1.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A flexible toy vehicle track, comprising: a track main body and at least one connecting portion, the track main body being connected to the connecting portion, the track main body comprising at least one track, and the track being configured for a toy vehicle to run on; the connecting portion being arranged on a side away from the track, and the connecting portion being configured for detachably connecting the flexible toy vehicle track to another flexible toy vehicle track;

wherein the connecting portion extends from a first end of the track main body to a second end of the track main body along a lengthwise direction of the at least one track;

wherein the connecting portion comprises an enclosure wall, two ends of the enclosure wall are connected to the track main body, the enclosure wall and the track main body surround to form a connecting channel, the connecting channel is a completely closed channel, and the connecting channel is configured for coupling with the external connector;

wherein the connecting portion further comprises at least one side wall, the side wall is arranged in the connecting channel, and the side wall is configured for dividing the connecting channel into a first connecting channel and a second connecting channel;

wherein a first side of the side wall is connected to the track main body, a second side of the side wall is connected to the enclosure wall, and the side wall is configured for supporting the track main body and the enclosure wall, so as to prevent the track main body and the enclosure wall from a concave deformation or a convex deformation;

wherein the side wall extends from the first end of the track main body to the second end of the track main body, so that the first connecting channel and the second connecting channel extend from the first end of the track main body to the second end of the track main body.

2. The flexible toy vehicle track according to claim 1, wherein the connecting portion is configured for detachably connecting to other flexible toy vehicle tracks through an external connector.

3. The flexible toy vehicle track according to claim 1, wherein the surrounding wall extends from the first end of the track main body to the second end of the track main body, so that the connecting channel extends from the first end of the track main body to the second end of the track main body.

4. The flexible toy vehicle track according to claim 1, wherein a size of the first connecting channel is identical to a size of the second connecting channel, so that when the plurality of flexible toy vehicle tracks are connected by the external connector, a force on the first connecting channel and the second connecting channel is balanced.

5. The flexible toy vehicle track according to claim 1, wherein the enclosure wall comprises a first wall, a second wall, and a third wall; a first side of the first wall is connected to the track main body, a second side of the first wall is connected to a first side of the second wall, a second side of the second wall is connected to a first side of the third wall, and a second side of the third wall is connected to the track main body.

6. The flexible toy vehicle track according to claim 5, wherein the first wall and the second wall are arranged at a right angle relative to each other.

7. The flexible toy vehicle track according to claim 5, wherein the third wall and the second wall are arranged at a right angle relative to each other.

8. The flexible toy vehicle track according to claim 1, wherein the track main body further comprises a track panel and two baffles, the baffles are respectively connected to two sides of the track panel, and the two baffles are connected to the track panel to form the track.

9. The flexible toy vehicle track according to claim 8, wherein a width of the baffle plate gradually increasing from a top to a bottom is configured for forming an inclined guiding surface.

10. The flexible toy vehicle track according to claim 8, wherein the baffle extends from a first end of the track panel to a second end of the track panel, and the baffle is configured for preventing the toy vehicle from sliding out of the track.

11. The flexible toy vehicle track according to claim 8, wherein a rounded corner is provided on a side of the baffle away from the track panel.

12. The flexible toy vehicle track according to claim 1, wherein a material for manufacturing the flexible toy vehicle track is PVC.

13. The flexible toy vehicle track according to claim 1, wherein the flexible toy vehicle track is integrally formed by extrusion.

14. The flexible toy vehicle track according to claim 1, wherein a reinforcing rib is provided on two sides of the track main body to enhance the strength of the track main body.

15. The flexible toy vehicle track according to claim 1, wherein a cross section of the connecting portion is a flat shape, so that a thickness of the flexible toy vehicle track is reduced.

16. The flexible toy vehicle track according to claim 1, wherein the first connecting channel and the second connecting channel each extend from a first end of the track main body to a second end of the track main body along a lengthwise direction of the at least one track.

17. The flexible toy vehicle track according to claim 16, wherein the first connecting channel is parallel to the second connecting channel in an entire length of the at least one track.

* * * * *